US006141798A

United States Patent [19]

Manning

[11] Patent Number: 6,141,798

[45] Date of Patent: Nov. 7, 2000

[54] FRONT TORSO AND ARM COVERING BIB

[76] Inventor: Ileana Manning, 9861 S. 570 East, Sandy, Utah 84070

[21] Appl. No.: 09/258,332

[22] Filed: Feb. 25, 1999

[51] Int. Cl.[7] ..... A41B 13/10

[52] U.S. Cl. ..... 2/49.1; 2/49.2; 2/46; 2/52

[58] Field of Search ..... 2/48, 49.1, 49.2, 2/49.3, 49.4, 51, 52, 50, 46, 114, 106, 109, 113, 111; D2/860, 861, 862, 863, 864

[56] References Cited

U.S. PATENT DOCUMENTS

| | | | |
|---|---|---|---|
| D. 288,022 | 2/1987 | Marconi | D2/862 |
| 1,963,130 | 6/1934 | Hall . | |
| 2,451,038 | 10/1948 | Mink . | |
| 2,620,475 | 12/1952 | Legg et al. . | |
| 2,635,243 | 4/1953 | Eskey . | |
| 2,688,750 | 9/1954 | Mink . | |
| 2,922,164 | 1/1960 | Liff . | |
| 3,229,875 | 1/1966 | Stoller . | |
| 3,407,407 | 10/1968 | Hollander et al. . | |
| 3,557,385 | 1/1971 | Hendrickson . | |
| 4,570,268 | 2/1986 | Freeman | 2/114 |
| 4,779,288 | 10/1988 | Mack | 2/49.3 |
| 4,884,298 | 12/1989 | Silas | 2/49.1 |
| 5,005,217 | 4/1991 | Bern et al. | 2/104 |
| 5,023,953 | 6/1991 | Bettcher | 2/51 |
| 5,410,758 | 5/1995 | Dupont et al. | 2/51 |
| 5,454,119 | 10/1995 | Thomm | 2/114 |
| 5,682,609 | 11/1997 | Ayo | 2/49.2 |

*Primary Examiner*—Amy B. Vanatta

[57] ABSTRACT

A front torso and arm covering bib for protecting the front torso, shoulders and arms regions of a user's garment for soiling. The front torso and arm covering bib includes a front torso panel with a spaced apart pair of shoulder flaps extending therefrom and a neck cutout interposed between the shoulder flaps. Each of the sides of the front torso panel has a sleeve outwardly extending therefrom adjacent a corresponding shoulder flap of the front torso panel. The sleeves each have a cuff around the wrist opening of the respective sleeve for constricting the wrist opening of the respective sleeve around the corresponding wrist of the wearer. A pair of elongate flexible neck ties are coupled to the upper region of the front torso panel.

13 Claims, 1 Drawing Sheet

FRONT TORSO AND ARM COVERING BIB

BACKGROUND OF THE INVENTION

1. Field of the Invention

The present invention relates to bibs and more particularly pertains to a new front torso and arm covering bib for protecting the front torso, shoulders and arms regions of a user's garment for soiling.

2. Description of the Prior Art

The use of bibs is known in the prior art. More specifically, bibs heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,036,547; U.S. Pat. No. 5,490,289; U.S. Pat. Des. No. 288,022; U.S. Pat. No. 1,963,130; U.S. Pat. No. 5,682,609; and U.S. Pat. No. 5,504,941.

While these devices fulfill their respective, particular objectives and requirements, the aforementioned patents do not disclose a new front torso panel with a spaced apart pair of shoulder flaps extending therefrom and a neck cutout interposed between the shoulder flaps. Each of the sides of the front torso panel has a sleeve outwardly extending therefrom adjacent a corresponding shoulder flap of the front torso panel. The sleeves each have a cuff around the wrist opening of the respective sleeve for constricting the writ opening of the respective sleeve around the corresponding wrist of the wearer. A pair of elongate flexible neck ties are coupled to the upper region of the front torso panel. A bottom pouch is coupled to a lower region of the front torso panel.

In these respects, the front torso and arm covering bib according to the present invention substantially departs from the conventional concepts and designs of the prior art, and in so doing provides an apparatus primarily developed for the purpose of protecting the front torso, shoulders and arms regions of a user's garment for soiling.

SUMMARY OF THE INVENTION

In view of the foregoing disadvantages inherent in the known types of bibs now present in the prior art, the present invention provides a new front torso and arm covering bib construction wherein the same can be utilized for protecting the front torso, shoulders and arms regions of a user's garment for soiling.

The general purpose of the present invention, which will be described subsequently in greater detail is to provide a new front torso and arm covering bib apparatus and method which has many of the advantages of the bibs mentioned heretofore and many novel features that result in a new front torso and arm coverings bib which is not anticipated, rendered obvious, suggested, or even implied by any of the prior art bibs, either alone or in any combination thereof.

To attain this, the present invention generally comprises a front torso panel with a spaced apart pair of shoulder flaps extending therefrom and a neck cutout interposed between the shoulder flaps. Each of the sides of the front torso panel has a sleeve outwardly extending therefrom adjacent a corresponding shoulder flap of the front torso panel. The sleeves each have a cuff around the wrist opening of the respective sleeve for constricting the wrist opening of the respective sleeve around the corresponding wrist of the wearer. A pair of elongate flexible neck ties are coupled to the upper region of the front torso panel. A bottom pouch is coupled to a lower region of the front torso panel.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new front torso and arm covering bib apparatus and method which has many of the advantages of the bibs mentioned heretofore and many novel features that result in a new front torso and arm covering bib which is not anticipated, rendered obvious, suggested, or even implied by any of the prior art bibs, either alone or in any combination thereof.

It is another object of the present invention to provide a new front torso and arm covering bib which may be easily and efficiently manufactured and marketed.

It is a further object of the present invention to provide a new front torso and arm covering bib which is of a durable and reliable construction.

An even further object of the present invention is to provide a new front torso and arm covering bib which is susceptible of a low cost of manufacture with regard to both materials and labor, and which accordingly is then susceptible of low prices of sale to the consuming public, thereby making such front torso and arm covering bib economically available to the buying public.

Still yet another object of the present invention is to provide a new front torso and arm covering bib which provides in the apparatuses and methods of the prior art some of the advantages thereof, while simultaneously overcoming some of the disadvantages normally associated therewith.

Still another object of the present invention is to provide a new front torso and arm covering bib for protecting the front torso, shoulders and arms regions of a user's garment for soiling.

Yet another object of the present invention is to provide a new front torso and arm covering bib which includes a front torso panel with a spaced apart pair of shoulder flaps extending therefrom and a neck cutout interposed between the shoulder flaps. Each of the sides of the front torso panel has a sleeve outwardly extending therefrom adjacent a corresponding shoulder flap of the front torso panel. The sleeves each have a cuff around the wrist opening of the respective sleeve for constricting the wrist opening of the respective sleeve around the corresponding wrist of the wearer. A pair of elongate flexible neck ties are coupled to the upper region of the front torso panel. A bottom pouch is coupled to a lower region of the front torso panel.

Still yet another object of the present invention is to provide a new front torso and arm covering bib that protects the sleeves of a user's garment from soiling when eating with the bib thereon.

Even still another object of the present invention is to provide a new front torso and arm covering bib that may preferably have a front torso portion with sides that may be wrapped around the sides and back of the wearer when the back and waist ties are tied behind the back of the wearer.

These together with other objects of the invention, along with the various features of novelty which characterize the invention, are pointed out with particularly in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
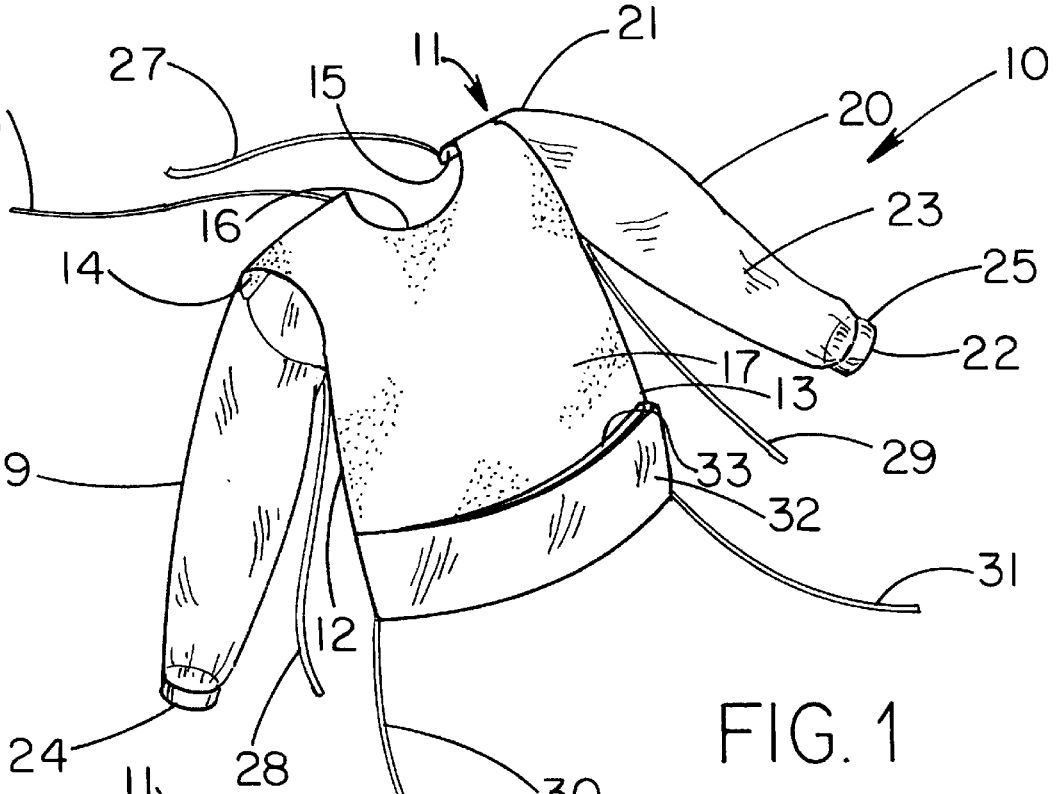
FIG. 1 is a schematic front isometric view of a new front torso and arm covering bib according to the present invention.
Figure 2:
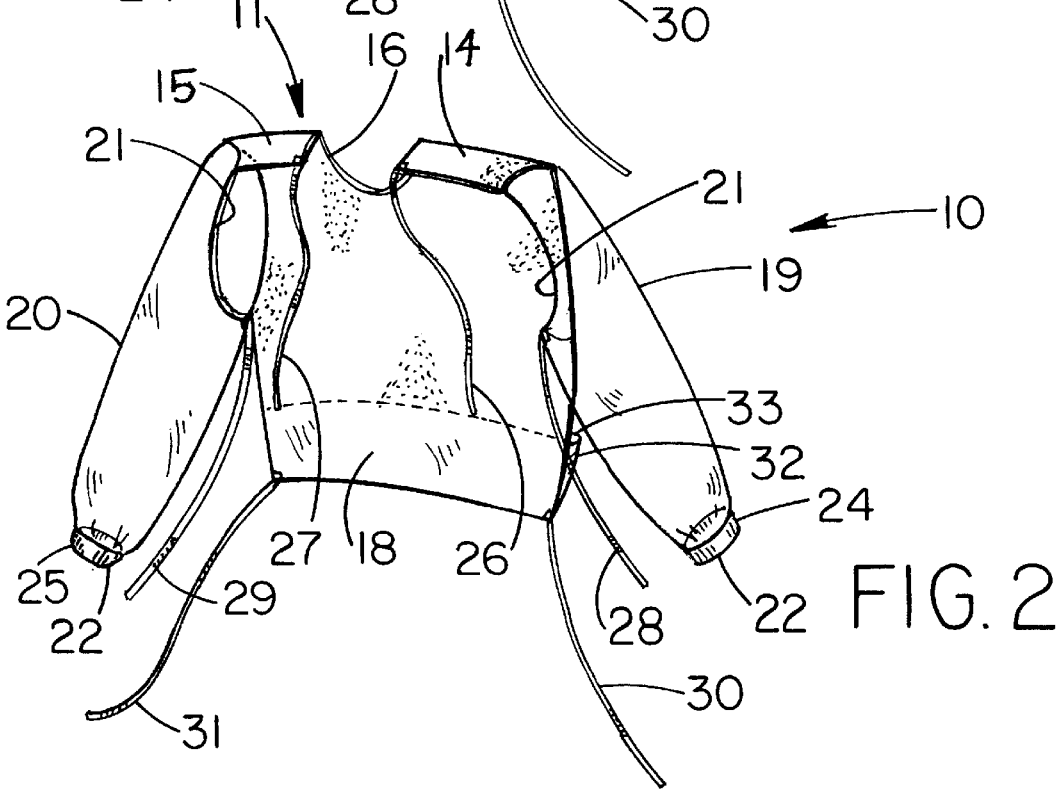
FIG. 2 is a schematic rear isometric view of the present invention.

With reference now to the drawings, and in particular to FIGS. 1 through 2 thereof, a new front torso and arm covering bib embodying the principles and concepts of the present invention and generally designated by the reference numeral 10 will be described.

As best illustrated in FIGS. 1 through 2, the front torso and arm covering bib 10 generally comprises a front torso panel with a spaced apart pair of shoulder flaps extending therefrom and a neck cutout interposed between the shoulder flaps. Each of the sides of the front torso panel has a sleeve outwardly extending therefrom adjacent a corresponding shoulder flap of the front torso panel. The sleeves each have a cuff around the wrist opening of the respective sleeve for constricting the wrist opening of the respective sleeve around the corresponding wrist of the wearer. A pair of elongate flexible neck ties are coupled to the upper region of the front torso panel. A bottom pouch is coupled to a lower region of the front torso panel.

In use, the bib 10 is designed for protecting the front torso, shoulders, and arms regions of a wearer's garment from soiling while eating or performing other messy activities. In closer detail, the bib 10 comprises a front torso panel 11 with upper and lower regions, and a pair of sides 12,13. In use, the front torso panel is designed for positioning over the front of a wearer's torso to substantially cover the front of the wearer's torso.

The upper region the front torso panel has a spaced apart pair of shoulder flaps 14,15 extending therefrom and a generally semi-circular arcuate neck cutout 16 interposed between the shoulder flaps. In use, the shoulder flaps are each designed for draping over a corresponding shoulder of the wearer to substantially cover the shoulders of the wearer to protect the shoulder regions of the wearer garments from soiling. The neck cutout is designed for receiving a front portion of a neck of the wearer therein so that upper region covers the collar region of the wearer.

Preferably, the front torso panel comprises a water absorbent material 17 such as a flexible fabric material such as cotton fabric material or even a terrycloth fabric material for absorbing fluids that spill on the front torso of the wearer. Even more preferably, the front torso panel has a substantially coextensive substantially water impermeable backing layer on a back face 18 of the front torso panel to prevent fluid spills absorbed by the water absorbent fabric material from seeping onto front of the wearer's garment covered by the front torso panel. Ideally, the backing layer comprises a substantially water impermeable flexible plastic material. Optionally, the front torso panel may simply comprise a substantially water impermeable flexible material (such as a water impermeable flexible plastic material) without presence of the water absorbing material so that the front torso panel can be cleaned by simply wiped down and rinsed off after user rather than requiring it to cleaned by laundering.

Each of the sides of the front torso panel has an associated sleeve 19,20 outwardly extending therefrom at the upper region of the front torso panel adjacent a corresponding shoulder flap of the front torso panel. Each of the sleeves has opposite open shoulder and wrist ends 21,22 with the open shoulder ends of the sleeves coupled to the associated upper region and the adjacent shoulder flap along the respective side of the front torso panel. In use, each of the sleeves is designed for extending a corresponding arm of the wearer therethrough such that the sleeves substantially cover the shoulders and arms of the wearer and the hands of the wearer extend through the wrist opening of the respective sleeve.

Preferably, the sleeves each comprise a substantially water impermeable flexible material 23 such as water impermeable flexible plastic material. Even more preferably, the sleeves each comprise a translucent (and ideally transparent) material such as a translucent or transparent plastic material.

The sleeves each have a cuff 24,25 around the wrist opening of the respective sleeve. In use, the cuffs are designed for constricting or cinching the wrist opening of the respective sleeve around the corresponding wrist of the wearer to help prevent soiling of the cuffs and sleeves of the wear's garments from food and liquids falling into the wrist openings. In one preferred embodiment, the cuffs each comprise an annular elastic band extended around the wrist opening of the respective sleeve. In another preferred embodiment, the cuffs each comprise a pair of wrist straps designed for wrapping around the corresponding wrist of the wearer with each pair of wrist straps having a hook and loop fastener detachably coupling the respective pair of wrist straps together.

A pair of elongate flexible neck ties 26,27 are coupled to the upper region of the front torso panel. Preferably, one of the neck ties is coupled to a corner of one of the shoulder flaps located adjacent the neck opening and the other of the neck ties is coupled to a corner of the other of the shoulder flaps located adjacent the neck opening. In use, the neck ties are designed for tying around the neck of the wearer to secure the upper region of the front torso panel to the neck of the wearer.

Each of the sides of the front torso panel preferably has an elongate flexible back tie 28,29 coupled thereto adjacent the shoulder end of the adjacent associated sleeve. In use, the back ties are designed for typing around the back of the wearer just beneath the armpits of the wearer to secure the front torso panel to the wearer's torso.

A pair of elongate flexible waist ties 30,31 are also preferably provided and coupled to the lower region of the front torso panel with one of the waist ties coupled to a lower corner of one of the sides of the front torso panel and the other of the waist ties coupled to a lower corner of the other side of the front torso panel. In use, the waist ties are designed for tying around the waist of the wearer to secure the lower region of the front torso panel to the waist of the wearer.

Preferably, the sides of the front torso panel are wrapped (preferably flush) around the sides and back of the wearer's torso and cover the sides and the lower back region of the wearer's torso when the back and waist ties are tied behind the back of the wearer to provide further protection to soiling to the back and sides of garments on the wearer's torso.

An open-topped bottom pouch 32 is coupled to the front of the lower region of the front torso panel. The bottom pouch is designed for catching and collecting falling items therein such as food and other debris. The bottom pouch preferably comprises generally rectangular front and back panels coupled together along the bottom and sides outer perimeters of the front and back panels so that the front and back panels of the pouch define a top opening 33 into the bottom pouch. The bottom pouch has a pair of opposite ends with one of the ends of the bottom pouch preferably substantially collinear with one of the sides of the front torso panel and the other of the ends of the bottom pouch preferably substantially collinear with the other of the sides of the front torso panel so that the bottom pouch extends across the entire bottom of the front torso panel. Preferably, the bottom pouch comprises a water impermeable flexible material such as a water impermeable flexible plastic material that even more preferably is also translucent or transparent.

As to a further discussion of the manner of usage and operation of the present invention, the same should be apparent from the above description. Accordingly, no further discussion relating to the manner of usage and operations will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A bib, comprising:

a front torso panel having a pair of sides, a spaced apart pair of shoulder flaps extending therefrom and a neck cutout interposed between said shoulder flaps;

each of said sides of said front torso panel having a sleeve outwardly extending therefrom adjacent a corresponding shoulder flap of said front torso panel, each of said sleeves having opposite open shoulder and wrist ends;

said sleeves each having a cuff around said wrist opening of the respective sleeve, said cuffs being adapted for constricting said wrist opening of the respective sleeve around the corresponding wrist of the wearer;

a pair of elongate flexible neck ties each being coupled to said upper region of said front torso panel above said open shoulder end of said sleeve;

a pair of elongate flexible chest ties each being coupled to a middle region of said front torso panel below and adjacent to said open shoulder end of said sleeve such that said neckties and said chest ties hold each of said open shoulder ends snugly about a shoulder of a wearer;

a pair of elongate flexible waist ties being coupled to a lower region of said front torso panel for holding said front torso panel adjacent to a torso of the wearer; and a bottom pouch being coupled to said lower region of said front torso panel.

2. The bib of claim 1, wherein said front torso panel comprises a water absorbent material.

3. The bib of claim 2, wherein said front torso panel has a substantially coextensive and substantially water impermeable backing layer on a back face of said front torso panel.

4. The bib of claim 1, wherein said front torso panel comprises substantially water impermeable material.

5. The bib of claim 1, wherein said sleeves each comprise a substantially water impermeable material.

6. The bib of claim 5, wherein said sleeves each comprise a translucent material.

7. The bib of claim 1, wherein said cuffs each comprise an annular elastic band extended around said wrist opening of the respective sleeve.

8. The bib of claim 1, wherein said cuffs each comprise a pair of wrist straps adapted for wrapping around the corresponding wrist of the wearer.

9. The bib of claim 8, wherein each pair of wrist straps has a hook and loop fastener detachably coupling the respective pair of wrist straps together.

10. A bib for protecting the front torso, shoulders, and arm regions of a wearer's garment from soiling while eating or performing other messy activities, said bib comprising:

a front torso panel having upper and lower regions, and a pair of sides;

said front torso panel being adapted for positioning over the front of a wearer's torso to substantially cover the front of the wear's torso;

said upper region said front torso panel having a spaced apart pair of shoulder flaps extending therefrom and a generally semi-circular circular arcuate neck cutout interposed between said shoulder flaps;

said shoulder flaps each being adapted for draping over a corresponding shoulder of the wearer to substantially cover the shoulders of the wearer to protect the shoulder regions of the wearer garments from soiling;

said neck cutout being adapted for receiving a front portion of a neck of the wearer therein so that upper region covers the collar region of the wearer;

said front torso panel comprising a water absorbent flexible fabric material for absorbing fluids that spill on the front torso of the wearer;

each of said sides of said front torso panel having an associated sleeve outwardly extending therefrom at said upper region of said front torso panel adjacent a corresponding shoulder flap of said front torso panel, each of said sleeves having opposite open shoulder and wrist ends, said open shoulder ends of said sleeves being coupled to said upper region and the adjacent shoulder flap along the respective side of said front torso panel;

each of said sleeves being adapted for extending a corresponding arm of the wearer therethrough such that the sleeves substantially cover the shoulders and arms of the wearer and the hands of the wearer extend through said wrist opening of the respective sleeve;

said sleeves each comprising a substantially water impermeable flexible plastic material, wherein said sleeves each comprise a translucent material;

said sleeves each having a cuff around said wrist opening of the respective sleeve, said cuffs being adapted for constricting or cinching said wrist opening of the respective sleeve around the corresponding wrist of the wearer to help prevent soiling of the cuffs and sleeves of the wearer's garments from food and liquids falling into the wrist openings;

a pair of elongate flexible neck ties being coupled to said upper region of said front torso panel, one of said neck ties being coupled to a corner of one of said shoulder flaps located adjacent said neck opening and the other of said neck ties being coupled to a corner of the other of said shoulder flaps located adjacent said neck opening;

said neck ties being adapted for tying around the neck of the wearer to secure said upper region of said front torso panel to the neck of the wearer;

each of said sides of said front torso panel having an elongate flexible back tie coupled thereto adjacent said shoulder end of the adjacent associated sleeves;

a pair of elongate flexible chest ties each being coupled to a middle region of said front torso panel below and adjacent to said open should end of said sleeve such that said neckties and said chest ties hold each of said open shoulder ends snugly about a shoulder of a wearer;

said chest ties being adapted for tying around the back of the wearer close beneath the armpits of the wearer to secure said front torso panel to the wearer's torso and to further couple the shoulder sleeves to the wearer;

a pair of elongate flexible waist ties being coupled to said lower region of said front torso panel, one of said waist ties being coupled to a lower corner of one of said sides of said front torso panel and the other of said waist ties being coupled to a lower corner of the other side of the front torso panel;

said waist ties being adapted for tying around the waist of the wearer to secure said lower region of said front torso panel to the waist of the wearer;

an open-topped bottom pouch being coupled to the front of said lower region of said front torso panel, said bottom pouch being adapted for catching and collecting falling items therein such as food and other debris;

said bottom pouch comprising generally rectangular front and back panels coupled together along the bottom and sides outer perimeters of said front and back panels, said front and back panels of said pouch defining a top opening into said bottom pouch; and said bottom pouch having a pair of opposite ends, one of said ends of said bottom pouch being substantially collinear with one of said sides of said front torso panel and the other of said ends of said bottom pouch being substantially collinear with the other of said sides of said front torso panel.

11. The bib of claim 10, wherein said front torso panel has a substantially coextensive substantially water impermeable backing layer on a back face of said front torso panel to prevent fluid spills absorbed by the water absorbent fabric material from seeping onto front of the wearer's garment covered by said front torso panel, said backing layer comprising a substantially water impermeable flexible plastic material.

12. The bib of claim 10, wherein said cuffs each comprise an annular elastic band extended around said wrist opening of the respective sleeve.

13. The bib of claim 10, wherein said cuffs each comprise a pair of wrist straps adapted for wrapping around the corresponding wrist of the wearer, wherein each pair of wrist straps has a hook and loop fastener detachably coupling the respective pair of wrist straps together.

* * * * *